United States Patent [19]

Claus et al.

[11] Patent Number: 5,024,737

[45] Date of Patent: Jun. 18, 1991

[54] PROCESS FOR PRODUCING A REACTIVE METAL-MAGNESIUM ALLOY

[75] Inventors: Kenneth G. Claus; Dwaine W. Schoppe; Matthew R. Earlam, all of Lake Jackson, Tex.

[73] Assignee: The Dow Chemical Company, Midland, Mich.

[21] Appl. No.: 364,771

[22] Filed: Jun. 9, 1989

[51] Int. Cl.[5] ..... C25C 3/36

[52] U.S. Cl. ..... 204/71; 204/68; 204/69; 204/70

[58] Field of Search ..... 204/70, 71, 68, 69, 204/246-247

[56] References Cited

U.S. PATENT DOCUMENTS

| | | | |
|---|---|---|---|
| 1,960,700 | 5/1934 | Gann et al. | 204/71 |
| 3,226,311 | 12/1965 | Van Diest | 204/69 |
| 3,268,427 | 8/1966 | Schucker et al. | 204/125 |
| 3,298,935 | 1/1967 | Henrie et al. | 204/1.5 |
| 3,503,857 | 3/1970 | Hard et al. | 204/71 |
| 3,524,700 | 8/1970 | Morrice, Jr. et al. | 204/71 |
| 3,729,397 | 4/1973 | Goldsmith et al. | 204/71 X |
| 4,065,602 | 12/1977 | Roche et al. | 429/72 |
| 4,684,448 | 8/1987 | Itoh et al. | 204/71 |
| 4,738,759 | 4/1988 | Bienvenu et al. | 204/60 |
| 4,786,319 | 11/1988 | Zeiringer | 75/10.62 |

FOREIGN PATENT DOCUMENTS

| | | | |
|---|---|---|---|
| 666281 | 2/1952 | United Kingdom | 204/71 |

OTHER PUBLICATIONS

V. I. Zuravlev, V. A. Lebdev, A. V. Volkovich, I. F. Nichkov, "Electrode Processes in the KCl-Na-Cl-$SrCl_2$ Melts on Molten Cathodes", Izv. V.U.Z. Tsvtn. Metall., (6), pp. 594-597, 1979.

N. V. Temnogrova, A. I. Demidov, A. G. Morachevskii, "Deposition of Lithium at Molten Metal Cathodes", Izv. V.U.Z. Tsvetn. Metall., (3), pp. 353-357, 1979.

I. S. Hirschhorn, "Commercial Production of Rare Earth Metals by Fused Salt Electrolysis", Journal of Metals, pp. 19-22, Mar., 1968.

G. Ferriere et al., "Depot Electrolytique du Lithium sur le Magnesium", Metaux, May, 1980, Seance Du, Dec. 13, 1943, pp. 603-605.

E. Morrice & M. M. Wong, "Fused-Salt Electrowinning and Electrorefining of Rare-Earth and Yttrium Metals", Minerals Sci. Engng., vol. 11, No. 3, pp. 125-136, Jul., 1979.

E. Morrice, J. E. Murphy & M. M. Wong, "Preparation of Rare-Earth and Yttrium Metals by Electrodeposition and Vacuum Distillation of Alloys", Bureau of Mines-Report of Investigations (7308), Oct., 1969, pp. 1-11.

P. Millet et al., "Preparation Electrolytique des Alliages Plomb-Calcium", Journal of Applied Electrochemistry 12, pp. 557-565, Feb., 1982.

N. V. Temnogorova et al., "Study of Lithium Deposition on Molten Metallic Cathodes", Chem Abstracts, 91: 80820j.

Du, Senlin et al., "Depolarization of Rare-Earth Metals on a Liquid Aluminum Cathode in Molten Chlorides", Chem. Abstracts, 107; 48165n. p. 551, 1987.

W. D. Threadgill, "Preparation of Metallic Calcium by Electrolysis of Calcium Oxide Dissolved in Molten Calcium Chloride".

V. I. Zhuravlev et al., "Electrolytic Deposition of Strontium and Lanthanum from Chloride Melts at a Molten Aluminum Cathode", Chem. Abstracts, 102; 102421e.

*Primary Examiner*—Donald R. Valentine

[57] ABSTRACT

A process for producing a magnesium-reactive metal alloy, for example a calcium-magnesium alloy, by electrodepositing the reactive metal from a molten salt bath containing a chloride of said reactive metal directly into a molten pool of magnesium.

14 Claims, 2 Drawing Sheets

PROCESS FOR PRODUCING A REACTIVE METAL-MAGNESIUM ALLOY

FIELD OF THE INVENTION

A salt of a reactive metal is electrolyzed and the reactive metal so-produced is collected in a molten magnesium cathode, thereby forming an alloy of the reactive metal and the magnesium.

BACKGROUND OF THE INVENTION

This invention relates to a process for producing alloys of active metals formed directly from their salts by molten salt electrolysis. One embodiment of this invention relates to a process for preparing a calcium and magnesium alloy.

The field of new metals and alloys has been growing rapidly as materials with new and better properties are needed. The use of a molten salt electrolysis process for the codeposition of metal alloys and the use of liquid metal cathodes in such processes are known. For example, calcium-lead alloys of 0.6% calcium are produced using liquid metal lead cathodes. The calcium-lead alloy is used in the production of lead plates for sulfuric acid batteries.

Magnesium as a liquid cathode has been used in a molten salt electrolysis process for preparing rare earth metal alloys as described in U.S. Pat. No. 3,729,397. The process of U.S. Pat. No. 3,729,397 includes adding a rare earth metal oxide as feed material to a fused salt bath comprising the fluorides of the rare earth metal and an alkali metal fluoride with the optional inclusion of an alkaline earth metal fluoride, and electrolyzing the electrolyte mixture using carbon anodes and as a cathode, molten magnesium which floats on the electrolyte mixture. The above process has several disadvantages including: evolution of fluorine gas at the anodes, high temperatures are needed to make fluoride salts molten.

U.S. Pat. No. 4,738,759 discloses a method for electrodepositing calcium or a calcium alloy to a liquid cathode of aluminum, tin, copper, lead or bismuth by electrolysis of a calcium derivative in a bath of molten salts based on calcium halides. The disadvantages of the above process include the use of relatively expensive calcium sources such as calcium carbide, calcium silicide, or calcium silicon and the necessity to take product from bottom of cell due to high density of liquid cathode metal.

While molten cathodes have been used to form alloys previously, molten magnesium cathodes have not been used to form alloys of reactive metals such as calcium. Active metals such as calcium, lithium, sodium and potassium are quite reactive and difficult to handle and prepare. Calcium-magnesium products, such as PELAMAG®, have been used in the steel industries. However, these products have been formed by physical mixing using pure calcium and magnesium compounds. Another method which has been used in the prior art to form a calcium-magnesium product includes impregnating a magnesium with calcium oxide.

Calcium-magnesium products produced by the prior art methods have low levels of calcium in the alloy. It is desired, therefore, to provide a process for producing a calcium-magnesium product with a much higher level of active calcium.

It is further desired to provide a process for producing alloys of active metals formed directly from their salts by molten salt electrolysis, more particularly, a process of electrodepositing the active metals directly into a molten magnesium cathode from a molten salt bath to form an alloy of magnesium and the respective active metal.

It is further desired to provide a process for producing a magnesium-active metal alloy which is much less reactive towards air than the active metal itself, and which is less reactive than magnesium.

It is desired to provide a cell where liquid magnesium in contact with a current source is the cathode in a molten salt system such that a reactive metal, for example lithium or calcium, can be electrowon from a molten salt bath forming an alloy at the molten magnesium cathode resulting in a molten alloy.

It is further desired to produce a calcium-magnesium product for use in the steel industry as a desulfurizer and dephosphorizer without having to handle calcium metal, because as aforementioned, calcium metal in its isolated form is a difficult to handle metal due to its reactivity.

An object of this invention is to produce an easy to handle calcium compound which can be used, for example, as a reducing agent in the metallothermic reduction of neodymium oxide or chloride and in many other applications where calcium is conventionally used.

SUMMARY OF THE INVENTION

The present invention is directed to a process for preparing magnesium-active metal alloys using a liquid magnesium cathode in a molten salt cell to produce magnesium-active metal alloys.

The present invention includes a process for producing a magnesium-reactive metal alloy by electrolysis of a molten salt bath wherein the alloy is formed on a liquid magnesium cathode comprising providing a molten magnesium metal in said bath: electrolyzing a molten chloride salt bath containing the chloride salt of the reactive metal, whereby said reactive metal is deposited on said magnesium cathode and alloys therewith: and removing the alloy from said bath.

Also, the present invention includes a method for preparing an alloy of calcium and magnesium including electrodepositing calcium from a molten salt bath containing calcium chloride directly into a molten pool of magnesium, forming an alloy of calcium and magnesium, which is then recovered from the cell.

The present invention advantageously does not isolate a metallic calcium, a very reactive and difficult to handle material. This process is much simpler and safer than previous processes using calcium metal.

DETAILED DESCRIPTION OF THE PREFERRED EMBODIMENT(S)

Figure 1:
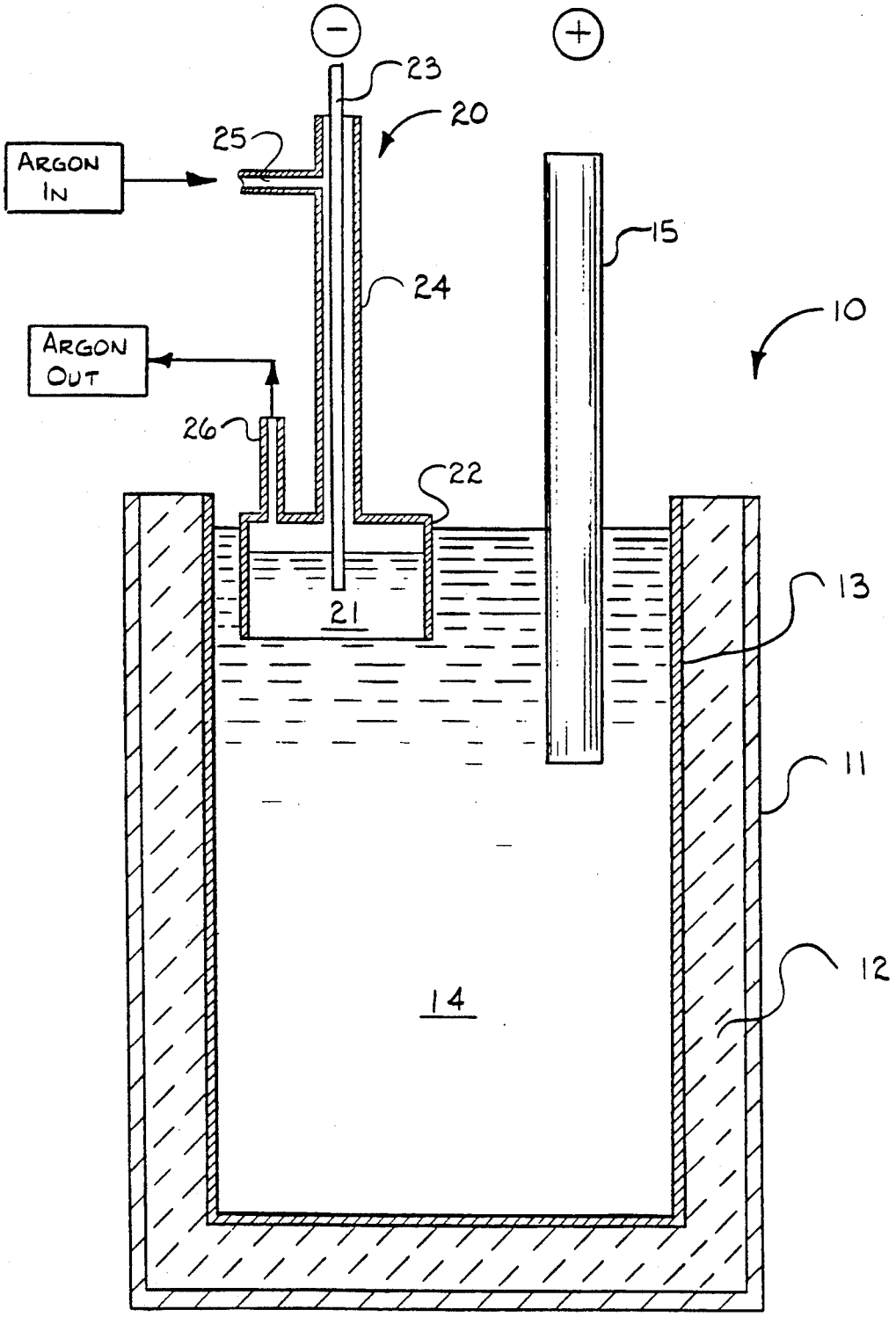
FIG. 1 is a schematic view showing a molten cell having a liquid cathode therein.

With reference to FIG. 1, an electrochemical cell represented generally by the numeral 10 is shown with a cell containment structure 11 with a heat-insulating layer 12 and an inner container layer 13 containing a volume of molten electrolyte 14, a positive electrode 15, and a negative electrode, generally indicated by numeral 20. The containment structure 11 can be of any conventional material for holding molten salt baths of the present invention. For example, rigid high temperature insulation brick, or steel or rigid insulated fiberboard can be used for the containment structure 11. The cell's refractory heat-insulating layer 12 can be made of, for example, brick and high temperature fiber board. The inner layer 13 is resistant to the attack of the bath 14 and is made of, for example, fused quartz, steel, tantalum, ceramics and various other known refractories.

The positive electrode (anode) 15 is of conventional type and may include graphite and any conductive material which is stable to chlorine gas concentrations and high temperatures such as above about 400 degrees C. and below about 1100 degrees C. The anode may be used in a variety of shapes such as a rod form, a plate form, a pipe form, a fluted form and the like.

The negative electrode (cathode) 20 is a molten cathode. The metal for the cathode is preferably added to the cell as ingots. The metal is preferably magnesium, aluminum, magnesium alloys or aluminum alloys. The cathode magnesium metal ingots are melted and the molten magnesium cathode 21 is contained in a suitable container 22, such as quartz or other materials such as alumina or spinel, magnesia, or any other nonconductive material stable at high temperatures and in high chlorine concentrations. The container 22 is preferably a cylindrical sleeve containing cathode 21.

Any conductive metal or ceramic may be used for an electrical connection to the molten cathode. The electrical connection is made to the molten cathode, for example, by a solid magnesium rod 23 enclosed in an alumina tube 24 positioned above and integral with the container 22. The magnesium rod 23 is preferably cooled by an inert gas such as argon which passes through an inlet tube 25 into the tube 24 and exits the tube 24 at outlet tube 26. Any material which is nonreactive with the product alloy material can be used for the cathode sleeve 24. For example, alumina and magnesia may be used for the cathode sleeve 24. The containers 22 an 24 may be one continuous piece and made of the same materials or may be two separate pieces of different materials.

Broadly speaking, the process of the present invention includes electrolytically depositing a reactive metal component of desired alloy directly into the molten magnesium cathode from a molten salt bath containing the chloride salt of the reactive metal to form a product alloy. The reactive metal component may be, for example, Ca, Li, Na, K and rare earth metals. The molten electrolyte or fused salt bath 14 can be a salt mixture of alkali and/or alkaline earth halides such as chlorides or fluorides. The composition of the bath can be, for example, from about20 to about 60% by weight of KCl and from about 40 to about 80% by weight of $CaCl_2$.

Other chloride salts of more negative reduction potential are also present in the bath. For example, $CaCl_2$, $BaCl_2$ and $SrCl_2$.

One advantage of the present process is the fact that an operator does not have to handle the second metal directly and thus makes for a safer procedure.

In a typical cell operation, a top tapping cell (float cell) or a bottom tapping cell (sink cell) can be used in the present invention. The type of cell used depends on the densities of the product and the electrolyte which can be determined by one skilled in the art.

Carrying out one embodiment of the process of the present invention generally involves first melting an electrolyte 14 in an electrochemical cell structure 10 at a temperature of from about 650 to about 850 degrees C. The cell temperature should be at a temperature to maintain the electrolyte in a molten condition. The cell 10 is operated at a temperature between about 650 to about 850 degrees C. because at temperatures lower than 650 C. the electrolyte may freeze and higher than 850 C. the electrolyte may begin to evaporate. Preferably, the process is carried out at a temperature of from about 680 C. to about 750 C.

After a dry anode 15 is inserted into the molten electrolyte as is well known in the art, the liquid magnesium cathode 21 is prepared by adding a magnesium cathode material to the container 22 and by melting the cathode material in the container 22. The temperature of the cell should already be at the temperatures aforementioned sufficient to melt the magnesium, i.e., the melting of magnesium metal is carried out between 650 and 850 degrees C. The molten cathode floats on the surface of the electrolyte.

An electrical element is connected to the molten magnesium. Electrical contact is made between the two electrodes and current is passed through the cell at a current density of about 0.1 to about 20 amps per square inch for enough ampere-hours to make the desired alloy composition. For example, to make an alloy of 70% magnesium and 30% calcium, one would start with a molten cathode of 700 grams of magnesium and an electrolyte containing calcium chloride, pass 401 ampere-hours of current through the cell, resulting in a molten cathode product containing 700 grams of magnesium and 300 grams of calcium. The desired ampere hours can be obtained by operating at a high cell amperage for a short period of time, or by operating at a low cell amperage for a longer period of time. The reactive metal from the molten salt bath is electrically deposited into the molten magnesium cathode to form an alloy of a reactive metal and magnesium in the container 22. The current is then turned off and the product is removed from the container 22.

The molten alloy collected at the cathode in the sleeve can be removed by conventional methods such as dipping with a ladle or pumping. The product alloy which is removed from the cathode tube can then be cast into a mold and allowed to cool.

The resulting product generally contains from about 1 to about 70 weight percent of the second metal. The desired amount of the second metal is dependent on the particular alloy system. For example, in the calcium-magnesium system an alloy with over 45 weight percent calcium takes on the characteristics of calcium rather than that of magnesium. This is due to the alloy being on the calcium rich side of the intermetallic $Mg_2Ca$. As long as the product is on the magnesium rich side, the alloy retains characteristics similar to magnesium. Similar intermetallics exist for most other alloy systems.

The product obtained with the process of the present invention is usually a brittle, shiny metallic alloy which is stable in air. Possible products include alloys of sodium, potassium and lithium. The products may be used as desulfurization and/or dephosphorization agents for steel in a steel production process. The products may also be useful as reducing agents for neodymium production, or in any application wherein metallic reducing agents are used.

A magnesium-lithium alloy, for example, may have many uses. For example, a 10% lithium alloy may be used to make dry cell battery case. Batteries made of this material have an 0.2 volt higher cell voltage than conventional dry cells. The magnesium-lithium alloy itself appears to have similar corrosion behavior as a conventional AZ31A magnesium alloy used in this application. The magnesium-lithium alloy is heat treatable and ductile.

A magnesium-calcium alloy is particularly useful as dephosphorization agent or as combination dephosphorization and desulfurization agent for the steel industry.

Figure 2:
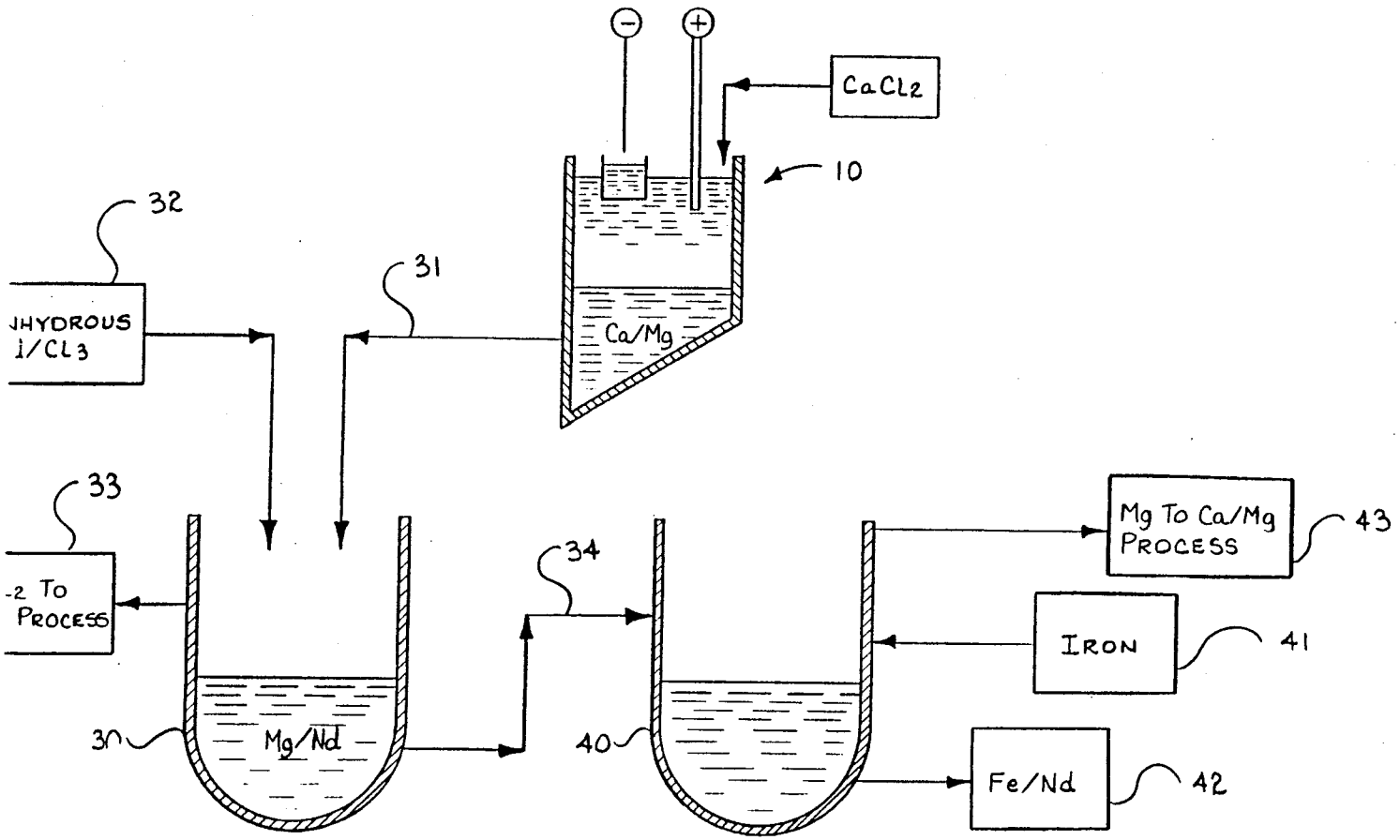
FIG. 2 is a schematic flow diagram view showing a molten salt electrolysis process using the molten cell of FIG. 1.

With reference to FIG. 2, there is shown a process using a magnesium-calcium alloy including an electrolytic cell 10 for producing the magnesium-calcium alloy. The alloy in stream 31 is passed to a vessel 30 for mixing with a neodymium chloride in stream 32 to form a magnesium-neodymium product. A calcium chloride 3 formed in vessel 30 is removed and passed to a use point. The magnesium-neodymium product in stream 34 is passed to a second distillation vessel 40 and mixed with iron 41 to form neodymium-iron product 42. Magnesium is recovered in stream 43.

Alternatively, the magnesium-neodymium product may be passed to a distillation vessel without the addition of iron (not shown) for decomposing the alloy and to recover the magnesium and the neodymium metals by distillation.

A neodymium metal product or a neodymium-iron product are useful for preparing neodymium based permanent magnets by well known techniques.

EXAMPLE 1

In a 2500 ml beaker, a mixture of 1000 g of $CaCl_2$ and 1000 g of KCl is melted and set at 700° C. A graphite rod is used as an anode and a pool of 30 g of molten magnesium contained in a quartz cylinder is used as a cathode. Electrical contact is made with the molten magnesium by a magnesium rod which is cooled by a gas such as argon passing through an annular space created by a sheath of alumina and the rod. The cell is run at 10 amps for a period of three hours, after which time the current is turned off, and the metal alloy removed from the quartz cylinder. The resulting product contains 22 percent calcium and 78 percent magnesium by weight and is very stable in air. The product is also brittle.

EXAMPLE 2

A three liter quartz beaker is placed in a furnace and charged with a mixture of 1200 grams of KCl and 1800 grams of $CaCl_2$. The furnace is started and the mixture melted. A graphite rod is placed into the electrolyte to act as an anode, and a pool of molten magnesium contained in a fused quartz cylinder acts as the cathode. The molten pool of magnesium is connected electrically using a solid rod of magnesium, which is blanketed by an argon flow to prevent oxidation. The magnesium used to form the molten pool weighed 7.09 grams. Cell operating temperature is 715 degrees C. The cell was operated at a current of 6.59 amps for 25 minutes, or a total of 2.7 amp hours. The resulting metal alloy formed at the cathode weighted 8.38 grams and had a composition of 15.4% Ca and 84.6% Mg. This is a current yield of 80%. The product is a metal similar to magnesium in appearance, which is somewhat brittle and very stable in air.

What is claimed is:

1. A process for producing a molten alloy of magnesium and calcium, said calcium being produced by electrolysis of a molten salt bath comprising the chloride of calcium, wherein the said alloy is formed in a molten magnesium cathode, said process comprising providing a molten magnesium metal cathode in said molten bath; electrolyzing a molten halide salt bath containing calcium chloride, whereby said calcium produced by the electrolysis is deposited in said molten magnesium cathode and alloys therewith; and removing the molten alloy from said bath.

2. The process of claim 1, further including the step of cooling said molten alloy.

3. The process of claim 1 wherein the temperature of the molten materials is maintained at from about 650 to about 850 degrees centigrade.

4. The process of claim 1 wherein the temperature of the molten materials is maintained at from about 680 to about 750 degrees centigrade.

5. The process of claim 1 wherein said calcium chloride is present in said bath in an amount of about 10 to about 80 weight percent of said bath.

6. A process for producing a molten alloy of magnesium and a reactive metal said reactive metal being produced by electrolysis of a molten salt bath comprising the chloride of calcium, lithium, sodium, or potassium, wherein the said alloy is formed in a molten magnesium cathode, said process comprising providing a molten magnesium metal cathode in said molten bath; electrolyzing a molten halide salt bath containing the chloride salt of the reactive metal, whereby said reactive metal produced by the electrolysis is deposited in said molten magnesium cathode and alloys therewith; and removing the molten alloy from said bath, and wherein the process is operated using an electrical element comprising a solid magnesium rod enclosed in a tube made of an inert material and cooled by an inert gas, said element being in electrical contact with the molten magnesium cathode.

7. The process of claim 6 wherein the reactive metal is lithium.

8. The process of claim 6 wherein the reactive metal is potassium.

9. The process of claim 6 wherein the reactive metal is sodium.

10. The process of claim 6 wherein said reactive metal chloride is present in said bath in an amount of about 10 to about 80 weight percent of said bath.

11. The process of claim 6 wherein the temperature of the molten materials is maintained at from about 650 to about 850 degrees centigrade.

12. The process of claim 6 wherein the reactive metal is calcium.

13. The process of claim 6, further including the step of cooling said molten alloy.

14. A process for preparing a molten calcium-magnesium alloy comprising electrodepositing calcium from a molten chloride salt bath containing calcium chloride directly into a molten pool of magnesium, wherein said magnesium is a molten cathode for the electrodeposition.

* * * * *